United States Patent [19]

Tanaka

[11] Patent Number: 4,794,812

[45] Date of Patent: Jan. 3, 1989

[54] GEAR-SHIFT LEVER HAVING VARIABLE THICKNESS WALLS

[76] Inventor: Takeru Tanaka, 1-3-18, Minami-shimizu-cho, Sakai, Japan

[21] Appl. No.: 123,945

[22] Filed: Nov. 23, 1987

Related U.S. Application Data

[62] Division of Ser. No. 875,270, Jun. 17, 1986, Pat. No. 4,732,030.

[51] Int. Cl.[4] ..... B60K 20/04
[52] U.S. Cl. ..... 74/473 P; 74/523
[58] Field of Search ..... 74/473 P, 523

[56] References Cited

U.S. PATENT DOCUMENTS 1,888,728 11/1932 Johnson ..... 74/473 P
1,896,893 2/1933 Hartsock ..... 74/473 P

*Primary Examiner*—Leslie A. Braun
*Assistant Examiner*—Scott Anchell
*Attorney, Agent, or Firm*—Moonray Kojima

[57] ABSTRACT

A transmission gear shifting lever of unibody construction from a hollow cylindrical material, comprising a connector part, a spherical part, a first cylindrical part, and a tubular lever body comprising a lower part, a tapered single cylindrical part, and a threaded part at the end, wherein the connecting part and the spherical part have wall thicknesses that are greater than the wall thickness of the first cylindrical part.

1 Claim, 2 Drawing Sheets

GEAR-SHIFT LEVER HAVING VARIABLE THICKNESS WALLS

This is a division of application Ser. No. 875,270, filed 6/17/86, now U.S. Pat. No. 4,732,030.

BACKGROUND OF THE INVENTION

Any of conventionally available power-driven vehicles and machinery uses a transmission-gear-shift lever having constitution such as the one shown in FIG. 10 for example.

To make up the shift lever shown in FIG. 10, plastic sphere 102 is first secured to the external surface of relatively short metal base tube 101 which extends itself straight-forwardly, while securing plastic sphere 102 to lever retainer (not shown), lever body 103 made of solid metal is integrally connected to the upper part of said base tube 101 using welding means. Next, screw 105 is secured to the upper end of said lever body 103 for installing knob 104 to said screw 105, and then metallic tube pivot 106 is integrally connected to the bottom part of said base tube 101 by applying welding means to allow shifting rod 107 to be connected to said tube pivot 106.

However, said shift-lever manufactured by the conventional method described above is still subjected to a variety of problems to solve, which are described below.

Since lever body 103 is substantially made of solid round rod, when operating said shift-lever connected to the predetermined part of the speed-changing gear, vibration generated by engine and transmission mechanism is directly transmitted to said shift-lever, thus eventually causing said shift-lever to continuously and slightly vibrate itself.

Structurally, since main components of any conventional shift-level are comprised of three units including base tube 101, sphere 102, and the lever body 103, a large number of component parts are needed, and yet, welding process is indispensible for connecting lever body 103 to base tube 101. Conversely, the welded portion generated by said welding process easily causes its mechanical strength to lower during service life.

In addition, reflecting a large number of component parts needed, assembly and control operations involve numerous processes.

Furthermore, since the lever body 103 itself is made of solid round bar, each piece is provided with a specific weight, and as a result, light-weight construction cannot easily be realized.

OBJECT OF THE INVENTION

The primary object of the present invention is to provide the novel method of manufacturing and the novel constitution of a power-transmission-gear-shifting lever featuring light weight and greater mechanical strength by sequentially applying processes including the following: first, expanded tubular portion is formed in an end of a tube made of plastic and/or metal, which is then processed by contraction means so that it can be converted into eliptic shape and interlinked part, which are then respectively cold-forged onto the spherical and interlinked parts before eventually making up a hollow shift-lever from a plastic or metal tube by applying construction process.

Another object of the present invention is to provide the novel method of manufacturing and the novel constitution of a power-transmission-gear-shifting lever which securely dispenses with a large number of component parts and numerous control processes duing assembly operation through minimum welding and assembly processes required, by integrally forming said tubular lever body in the upper portion and spherical-/interlinked portions in the lower portion by applying construction process.

A still further object of the present invention is to provide the novel method of manufacturing and the novel construction of a power-transmission-gear-shifting lever which is free from incurring even the slightest vibration by effectively absorbing vibration from engine and transmission mechanism through the hollow portion by making up a hollow shift-lever by applying cold-forging process.

A still further object of the present invention is to provide the novel method of manufacturing and the novel constitution of a power-transmission-gear-shifting lever featuring smooth surface, extremely high dimensional accuracy, freedom from the needs of applying finish-up and modification processes after completing entire processes, and satisfactory appearance, by applying construction process with cold-forging means.

A still further object of the present invention is to provide the novel method of manufacturing and the novel constitution of a power-transmission-gear-shifting lever which smoothly allows expansion of tubular form when an end of the tube is expanded by punching means through a plurality of processes performed for sequentially expanding diameter to the tube.

A still further object of the present invention is to provide the novel method of manufacturing and the novel constitution of a power-transmission-gear shifting lever which allows tube pivot to be easily welded and the mechanical strength to substantially increase itself by forming tapered portion along the surface edge of interlinked portion to cause the thickness of said interlinked portion to substantially increase at the same time by applying pressure onto the edge surface of said interlinked portion connected to sphere in the tilted condition and in the direction of the axis of the tube.

It will be apparent to those skilled in the art that still further objects of the invention can explicitly be understood from the detailed description given hereinbelow in reference to the accompanying drawings that follow.

DESCRIPTION OF THE PREFERRED EMBODIMENTS

Referring now to the accompanying drawings, one of the preferred embodiments of the present invention is described below.

Figure 1:
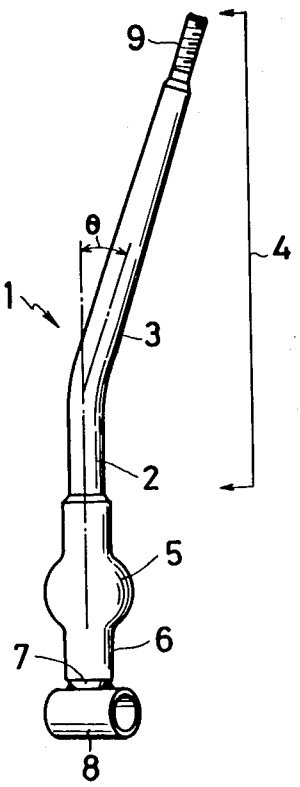
FIG. 1 is the perspective view of the transmission shifting lever manufactured by the method reflecting the present invention.

In FIG. 1, gear-shift lever 1 is integrally formed by combining processes and component parts according to sequential steps described below. By applying cold-forging process via pressing operation, spherical part 5 is secured to the lower portion of tubular lever body 4 whose upper tube portion 3 bends against base 2 by a specific angle $\theta$ such as 15° through 20° for example, short tubular connector part 6 being secured to the bottom part of said spherical part 5, and tapered part 7 being secured to the bottom surface of said connector part 6, respectively.

Short tubular tube pivot 8 is secured to said tapered part 7 by welding means.

Said tubular lever body 4 is provided with tapered configuration, where the lower part has a large diameter and the upper part has a small diameter. The upper end of said tubular lever body 4 is provided with screw 9.

Sphere 5 of gear-shifting lever 1 is pivotally held by lever retainer (not shown). Tube pivot 8 set to the bottom-end of the entire unit is connected to the shifting rod, whereas knob is secured to screw 9 on the upper-end of the entire unit so that a complete transmission-gear-shifting lever can be provided for service.

Next, stepwise method of manufacturing the transmission-gear-shifting lever 1 is described below.

Figure 2:
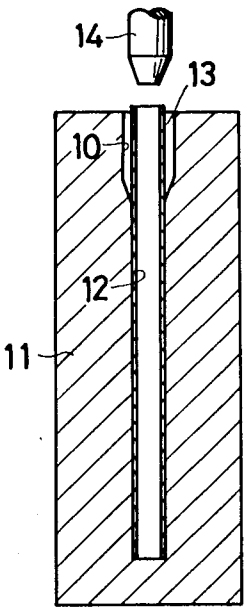
FIG. 2 is the sectional view denoting the preliminary step of the first-stage tube-expansion process.

As shown in FIG. 2, first, the first dice 11 having a specific surface configuration needed for the first-stage tube-expansion process is provided. Tube 13 is then fully inserted into flat-bottom-provided cylindrical dice hole 12 of dice 11.

Said tube 13 is made of plastic or metal and provided with a specific length.

Figure 3:
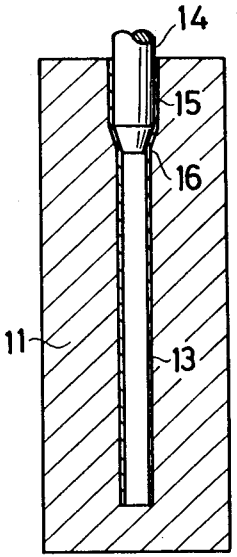
FIG. 3 is the sectional view denoting the first-stage tube-expansion process.

Then, as shown in FIGS. 2 and 3, the first-stage expanded tube part 15 is formed at the upper-edge portion of said tube 13 by inserting the first punch 14 into said upper-edge portion.

After forming said first-stage expanded-tube portion 15, taper-end portion 16 is formed between tube 13 and said first-stage expanded-tube portion 15.

The position at which said first-stage expanded-tube portion 15 is formed corresponds to the position of sphere 5 of the complete gear-shifting lever 1 shown in FIG. 1.

Said first dice 11 is provided with a knock-out pin as required.

Figure 4:
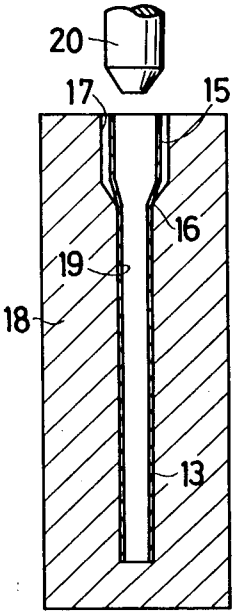
FIG. 4 is the sectional view denoting the preliminary step of the second-stage tube-expansion process.

Next, as shown in FIG. 4, the second dice 18 is provided for the position upper than the position that corresponds to said taper-end portion 16, in which said second dice 18 is provided with surface 17 needed for implementing the second-stage tube expansion process having a hole diameter wider than that of surface 10 needed for implementing the first-stage tube expansion process. Said tube 13 is then fully inserted into bottom-provided cylindrical dice hole 19 of the second dice 18.

Figure 5:
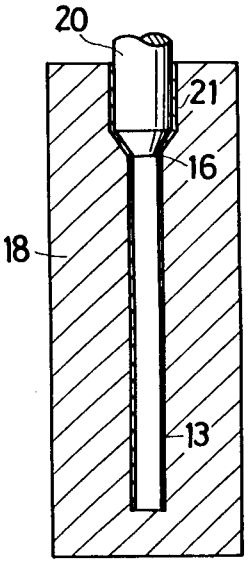
FIG. 5 is the sectional view denoting the second-stage tube-expansion process.
Figure 10:
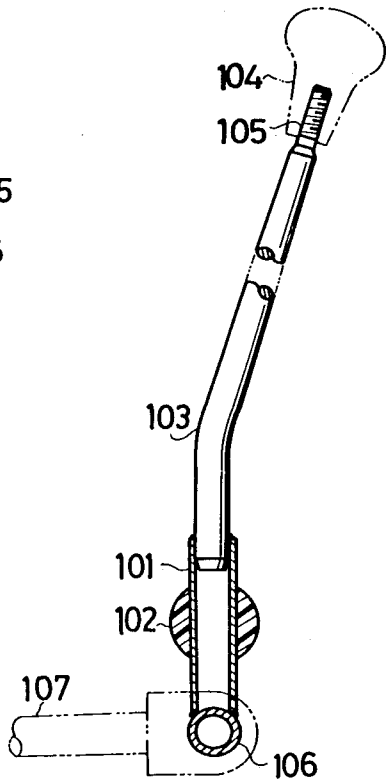
FIG. 10 (PRIOR ART)
FIG. 10 is the schematic exploded view of a conventional transmission gear shifting lever.

Then, as shown in FIGS. 4 and 5, the second punch 20 having a diameter wider than the outer diameter of the first punch 14 is inserted from the aperture of said first-stage expanded tube portion 15 to form the second-stage tube expanded portion 21 having a diameter wider than that of the first-stage expanded tube portion 15 at the upper edge of tube 13. The procedure described above now completes the first process.

The preferred embodiment thus provides the first-stage tube expansion process shown in FIGS. 2 and 3 and the second-stage tube expansion process shown in FIGS. 4 and 5. Implementation of these processes smoothly facilitates tube expansion process by sequentially expanding tube 13 by sequentially expanding diameters of punching means 14 and 20.

Needless to say that knock-out pins can be provided for said first dice 11 and second dice 18 as required.

Figure 6:
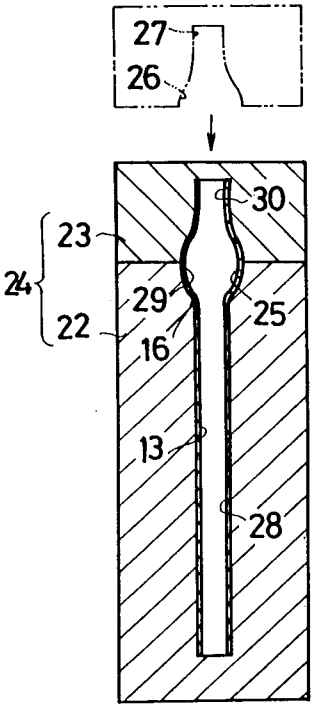
FIG. 6 is the sectional view denoting the process for forming proximate interim sphere of eliptic form.

Next, as shown in FIG. 6, the first mold 22 comprised of a pair of units including lower-mold 22 and upper-mold 23 being opposite from each other at the center portion of said second-stage tube expanded portion 21 is provided.

Said lower mold 22 and upper mold 23 are respectively provided with surfaces 25 and 26 making up interim eliptic shape close to sphere 5 shown in FIG. 1 so that they can be split into two parts between both molds. The upper mold 23 is provided with surface 27 of interlinked portion close to connector part 6 shown in FIG. 1, while said surface 27 is formed in connection with said surface 26 making up interim eliptic shape.

Next, said tube 13 is fully inserted into hole 28 of said lower mold 22. Then, the upper mold 23 which is movable against the stationary lower mold 22 is pressed to cause the second-stage tube expanded portion 21 shown in FIG. 5 to be deformed, and finally, interim eliptic portion 29 and interlinked portion 30 shown in FIG. 6 are respectively processed by contraction means. This completes the second process.

Figure 7:
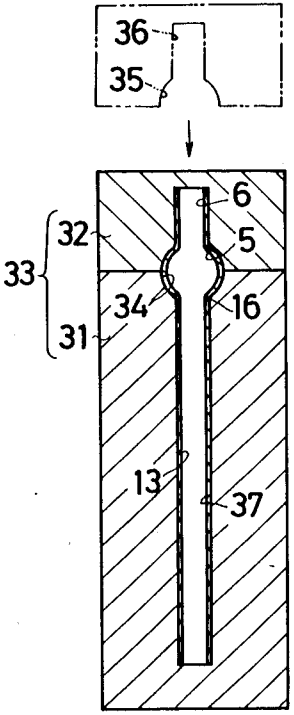
FIG. 7 is the sectional view denoting the sphere formation process.

Next, as shown in FIG. 7, the second mold 33 comprised of a pair of molds including the lower mold 31 and the upper mold 32 being opposite from each other at the center portion of said interim eliptic portion 29 is provided.

Said lower mold 31 and upper mold 32 are respectively provided with spherical surfaces 34 and 35 corresponding to sphere 5 shown in FIG. 1 so that they can be split into two parts between both molds. Said upper mold 32 is provided with surface 36 compatible with connector part 6 shown in FIG. 1 in connection with said spherical surface 35.

Next, tube 13 is fully inserted into hole 37 of said lower mold 31. Then, the upper mold 32 which is movable against the stationary lower mold 31 is pressed to cause interim eliptic portion 29 and interlinked portion 20 shown in FIG. 6 to be respectively deformed before eventually processing sphere 5 and connector part 6 shown in FIG. 7 by applying contraction means. This completes the third process.

Figure 8:
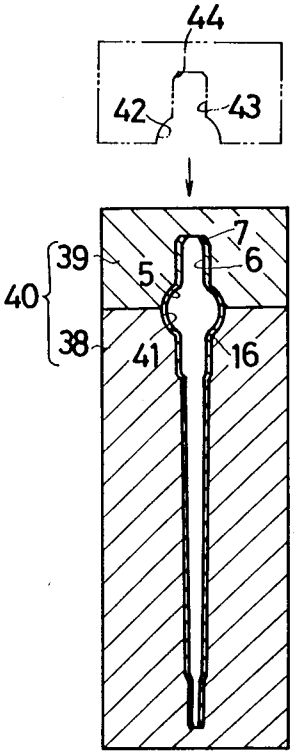
FIG. 8 is the sectional view denoting the process for forming tapered portion.

Next, as shown in FIG. 8, the third mold 40 comprised of a pair of molds including the lower mold 38 and the upper mold 39 being opposite from each other at the center portion of sphere 5 is provided.

Said lower mold 38 and upper mold 39 are respectively provided with spherical surfaces 41 and 42 compatible with the external configuration of sphere 5 so that they can be split into two parts between both molds. The upper molds 39 is provided with connection surface 43 compatible with the external configuration of connector portion 6 and tapered surface 44 compatible with tapered portion 7 of FIG. 1 in connection with said spherical surface 42.

Figure 9:
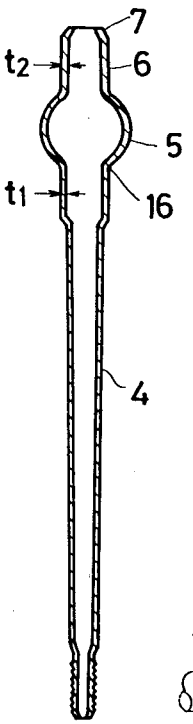
FIG. 9 is the enlarged sectional view denoting the shift-lever complete with the cold-forging process reflecting one of the preferred embodiments of the present invention.

Next, the upper mold 39 which is movable against the stationary lower mold 38 is pressed to cause the edge surface of connector portion 6 to be deformed in the tilted condition and in the direction of axis before eventually forming tapered portion 7 along the edge surface of said connector portion 6 to allow the thickness of said connector portion 6 to increase itself as shown in FIGS. 8 and 9. This completes the fourth process related to the preferred embodiment of the present invention.

In FIG. 9, there is depicted a gear shift lever structure which was obtained by the above described process, and which comprises a tapered lip 7, a connector part 6 having a wall thickness $t_2$, a spherical part 5, a cylindrical part (unnumbered) formed adjacent to a portion 16 of spherical part 5, and a tapered part 4. As can be seen and appreciated from FIGS. 2–5, the connector part 6 and spherical part 5 are prepared by the use of the punch and die, and then formed in FIGS. 6 and 7, and then the cylindrical part adjacent to portion 16 of spherical part 5, is formed in FIG. 8, from the cylindrical tube 13. Thus, it can be readily understood, that the wall thickness $t_1$ of the cylindrical part can be readily formed to be different from the wall thickness $t_2$ of the connector part 6 and spherical part 5. To put it another way, the connector part and spherical part are formed together with the punch and die and then the tapered part is formed in another step from the unformed tube.

Tube 13 below sphere 5 shown in FIG. 7 is first treated by several contraction processes (not shown) before eventually being deformed into the predetermined configuration shownin FIGS. 8 and 9.

More particulary, the lower part of said sphere 5 is processed into tapered shape by contraction means before eventually realizing the significantly tapered tubular lever body 4 shown in FIG. 9.

Next, threading process is applied to the tip-end of said tubular lever body 4 before shaping up screw part 9 shown in FIG. 9, and finally, said tubular lever body 4 is bent by a specific angle $\theta$ to complete the formation of the transmission-gear-shifting lever 1 shown in FIG. 1.

See FIG. 1. Tube pivot 8 is integrally welded to the bototm part of tapered portion 7. As mentioned earlier, since said connector part 6 and tapered portion 7 are respectively provided with enough thickness and also due to presence of said tapered portion 7, welding operation can easily be done. In particular, provision of enough thickness significantly improves the mechanical strength of these basic member parts.

Likewise, since the thickness of said screw part 9 is also provided with enough thickness by applying similar processing means, threaded screw 9 can constantly retain the predetermined strength.

In addition, tube 13 is made of either plastic or metallic material is contracted into hollow shifting lever 1 by applying cold forging process as mentioned eariler. This method allows the manufacturer to produce novel gear-shifting levers featuring significantly lighter weight than that of any conventional shifting levers, and yet, welding and assembly processes can be saved drastically.

The gear-shifting lever reflecting the preferred embodiment of the present invention uses significantly less number of member parts than any conventional gear-shifting levers, thus resulting in the reduced number of control processes, and in addition, it provides satisfactory appearance.

In particular, the preferred embodiment provides hollow shifting lever 1. The hollow constitution makes it possible for the lever to effectively absorb vibration from engine and transmission mechanism of motor-driven vehicles and the like, thus effectively prevents said lever 1 from incurring even the slightest vibration while engine and transmission mechanism are driven. The gear-shifting lever embodied by the present invention is complete with the cold-forging process which securely provides smooth surface and high precision of dimensions of the finished products.

As a result, neither finish-up process nor modification process is needed for the gear-shifting lever derived from the present invention.

Needless to say that said lower molds 22, 31, and 38 are respectively provided with knock-out pins as required.

The present invention being thus described. However it is obvious that the same way may be varied in many ways by those skilled in the art. It should be understood, however, that such variations are not to be regarded as a departure from the spirit and scope of the present invention, but all such modifications are intended to be included within the scope of the following claims.

What is claimed is:

1. A one-piece elongated tubular transmission gear shift lever, said gear shift lever comprising a tubular connector part at a first end of said gear shift lever, whereby said tubular connector part is adapted to be secured to a pivot means;

a spherical part extending from said connector part, said connector part and said spherical part having a first wall thickness;

a cylindrical part extending from said spherical part in a direction opposite said tubular connector part, said cylindrical part having a second wall thickness less than said first wall thickness;

a tapered part extending from said cylindrical part; and a threaded part extending from said tapered part, said threaded part formed at a second end of said gear shift lever opposite said fist end, whereby a gear shift knob may be attached.

* * * * *